US008725010B2

(12) United States Patent
Liu

(10) Patent No.: US 8,725,010 B2
(45) Date of Patent: May 13, 2014

(54) PRINT DEVICE WITH PRINTED SURFACE IDENTIFYING FUNCTION AND PRINTING METHOD

(75) Inventor: Lin Liu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 95 days.

(21) Appl. No.: 13/337,065

(22) Filed: Dec. 24, 2011

(65) Prior Publication Data

US 2013/0148986 A1 Jun. 13, 2013

(30) Foreign Application Priority Data

Dec. 8, 2011 (CN) ..... 2011 1 0406287

(51) Int. Cl.
*G03G 15/00* (2006.01)

(52) U.S. Cl.
USPC ..... 399/15

(58) Field of Classification Search
USPC ..... 399/15, 45
See application file for complete search history.

(56) References Cited

U.S. PATENT DOCUMENTS

2008/0013970 A1* 1/2008 Kikuchi ..... 399/45

* cited by examiner

*Primary Examiner* — Walter L Lindsay, Jr.
*Assistant Examiner* — Barnabas Fekete
(74) *Attorney, Agent, or Firm* — Novak Druce Connolly Bove + Quigg LLP

(57) ABSTRACT

A print device with a surface identifying function includes a feed roller assembly, a print assembly, and a printed surface identifying assembly. The feed roller assembly feeds the paper into the print device when receiving a printing task. The printed surface identifying assembly identifies whether one or both surfaces of a sheet of paper have already been printed, generates and sends a result to a processing unit. The processing unit determines whether the paper is available for printing according to the result, and control the print assembly not to perform the printing task and the feed roller assembly to take the paper out of the print device when the paper is unavailable for printing. A printing method is also provided.

8 Claims, 3 Drawing Sheets

PRINT DEVICE WITH PRINTED SURFACE IDENTIFYING FUNCTION AND PRINTING METHOD

BACKGROUND

1. Technical Field

The present disclosure relates to a print device and a printing method, and more particularly, to a print device with printed surface identifying function and the printing method thereof.

2. Description of Related Art

Printing devices produce text or graphics of documents stored in electronic form on a physical print media such as paper.

However, conventional print devices are not able to distinguish whether one or both surface of a sheet of paper have already been printed when performing a printing task. If a printed surface of the paper is put into the print device and not oriented properly, the printed surface of the paper will be double-printed, resulting in a waste of resources and time.

BRIEF DESCRIPTION OF THE DRAWINGS

Many aspects of the present embodiments can be better understood with reference to the drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Embodiments of the present disclosure will be described with reference to the accompanying drawings.

Figure 1:
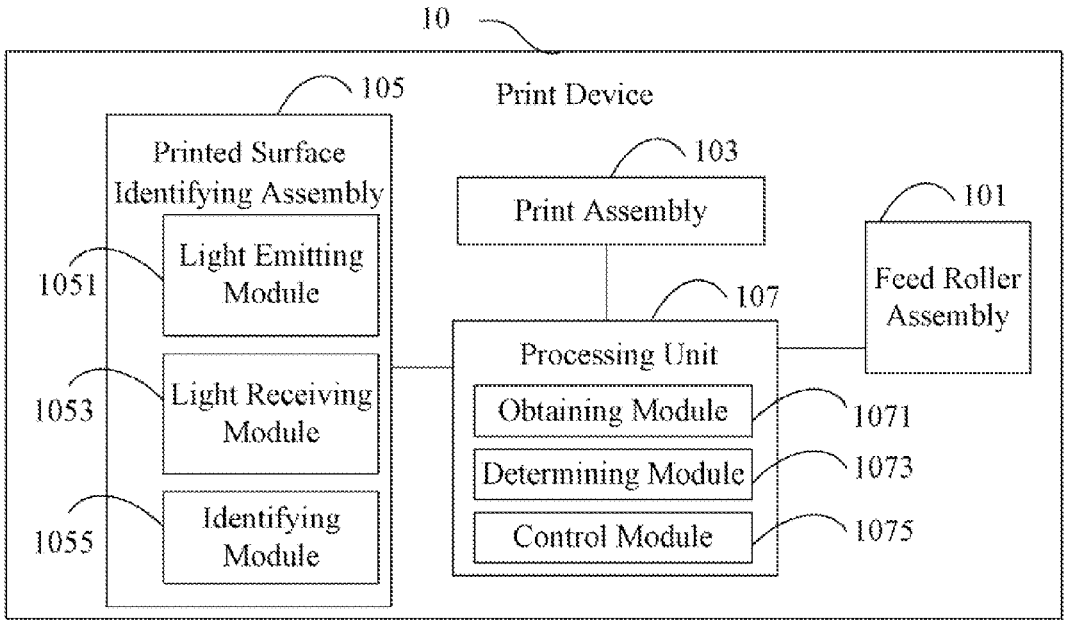
FIG. 1 is a block diagram of an embodiment of a print device with printed surface identifying function, in accordance with the present disclosure.

FIG. 1 is a block diagram of an embodiment of a print device with a printed surface identifying function. The print device 10 includes a feed roller assembly 101, a print assembly 103, a printed surface identifying assembly 105, and a processing unit 107. The print device 10 may be a printer.

The feed roller assembly 101 feeds a sheet of paper into the print device 10 and takes the sheet of paper out of the print device 10 by rotating of one or more rollers.

The print assembly 103 includes a print head, for depositing ink or other visible material on the paper to form an image, or forming an image by other means. The printed surface identifying assembly 105 is configured to identify whether one or both surfaces of the paper to be printed have already been printed and send a result to the processing unit 107.

The processing unit 107 is configured to control the feed roller assembly 101 to feed the paper into the print device 10 when receiving a printing task, and determine whether the printing task can be carried out, according to the printing task and the result transmitted by the printed surface identifying assembly 105. The processing unit 107 is further configured to control the print assembly 103 to work and the feed roller assembly 101 into take the paper out of the print device 10 after being printed when the printing task is possible to be carried out, and control the print assembly 103 not to work and the feed roller assembly 101 to take the paper out of the print device 10 when the printing is not possible, that is to say, the surface of the paper to be printed has already been printed.

The printed surface identifying assembly 105 includes a light emitting module 1051, a light receiving module 1053, and an identifying module 1055. The functions of the units (shown in FIG. 1) will be described and correlated with the method illustrated in FIG. 2.

The processing unit 107 includes an obtaining module 1071, a determining module 1073, and a control module 1075. The functions of the modules (shown in FIG. 1) will be described and correlated with the method illustrated in FIG. 3.

Figure 2:
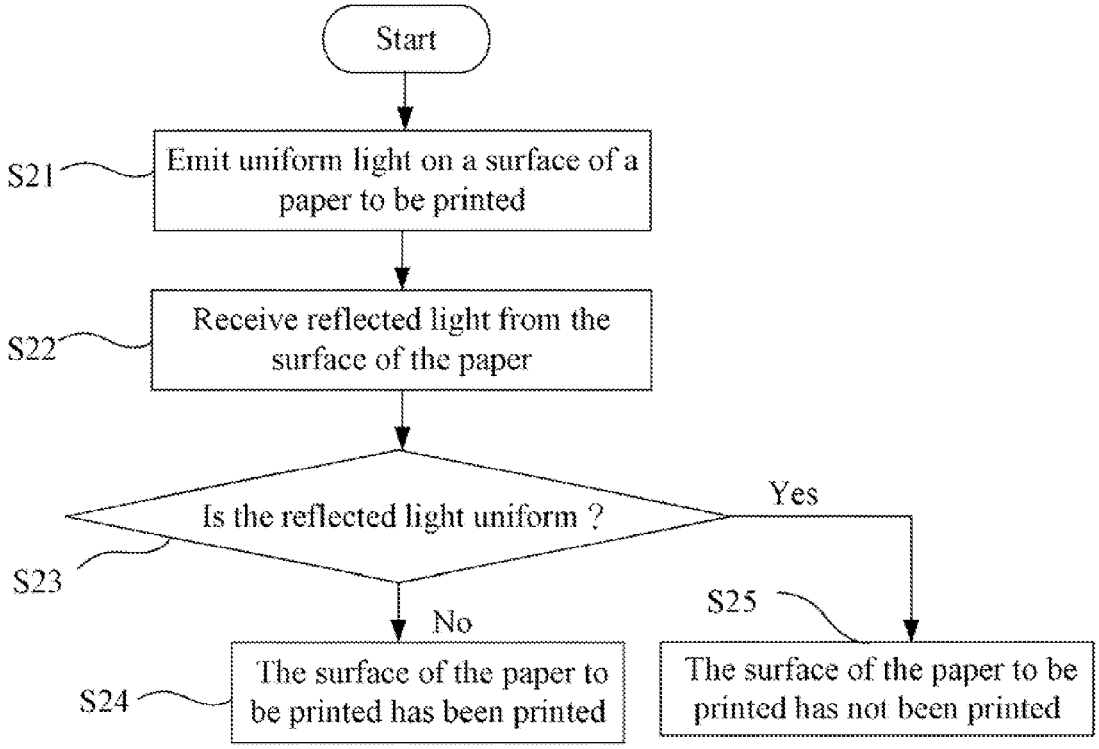
FIG. 2 is a flowchart of an embodiment of printed surface identifying process implemented by the print device in FIG. 1, in accordance with the present disclosure.

FIG. 2 is a flowchart of an embodiment of a printed surface identifying process implemented by the print device in FIG. 1. In step S21, the light emitting module 1051 emits uniform light onto the surface of the paper to be printed. The light emitting module 1051 may be an illuminant, installed over or under the surface of the paper being printed.

In step S22, the light receiving module 1053 receives reflected light from the surface of the paper. The light receiving module 1053 and the light emitting module 1051 are installed together over or under one surface of the paper being printed.

In step S23, the identifying module 1055 determines whether the reflected light is uniform, if yes, the procedure goes to step S25. If no, the procedure goes to step S24. The method of determining whether the reflected light is sufficiently uniform to indicate a blank or print-ready surface can be referenced from correlated knowledge.

In step S24, the identifying module 1055 determines that the surface of the paper to be printed has already been printed.

In step S25, the identifying module 1055 determines that the surface of the paper to be printed has not been printed.

Figure 3:
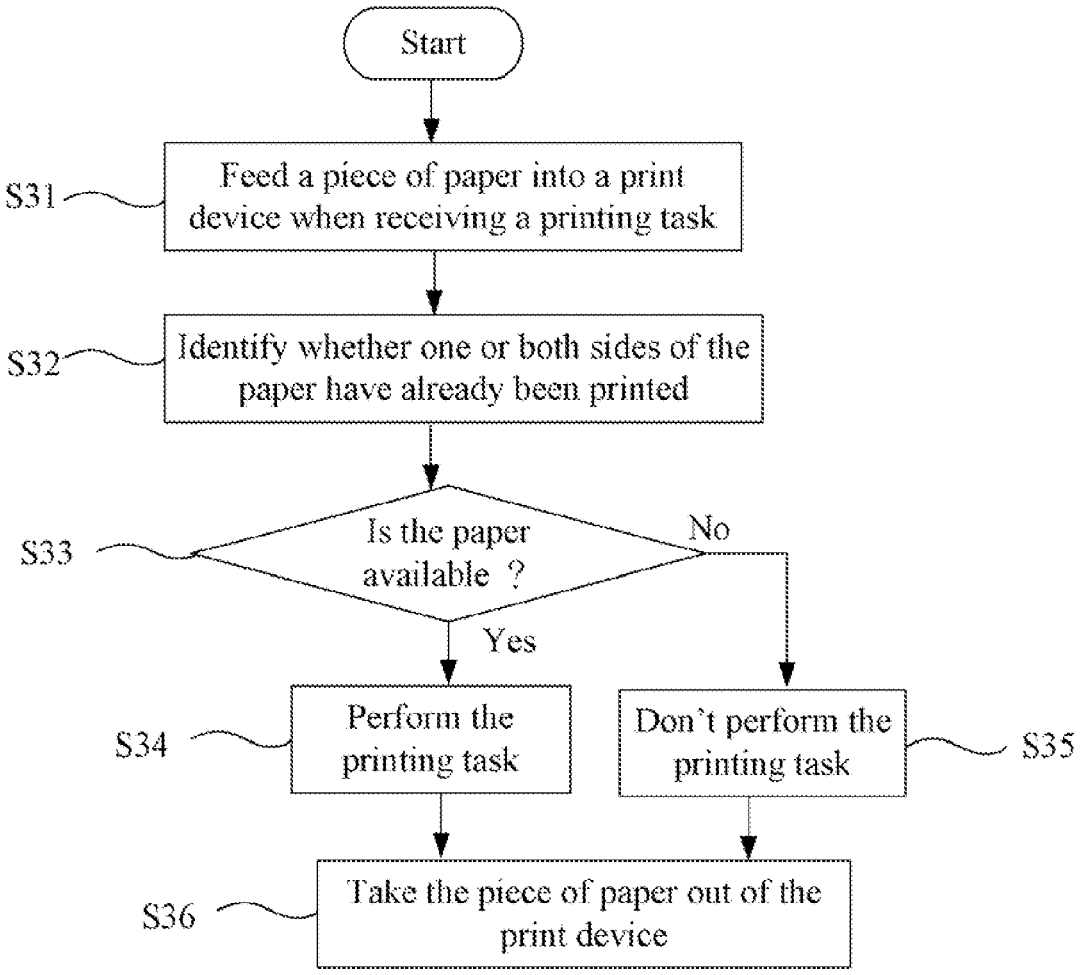
FIG. 3 is a flowchart of an embodiment of a process of performing a printing task as implemented by the print device in FIG. 1, in accordance with the present disclosure.

FIG. 3 is a flowchart of an embodiment of performing a print task as implemented by the print device in FIG. 1.

In step S31, the obtaining module 1071 controls the feed roller assembly 101 to feed the paper into the print device 10 when receiving a printing task.

In step S32, the printed surface identifying assembly 105 identifies whether the surface of the paper to be printed has already been printed, generates the result and sends the result to the obtaining module 1071.

When the printing task is one-sided printing, the printed surface identifying assembly 105 only needs to identify whether the surface of the paper to be printed has already been printed, and when the printing task is duplex or double-sided printing, the printed surface identifying assembly 105 needs to identify whether both surfaces of the paper have already been printed.

In step S33, the determining module 1073 determines whether the paper is available for printing according to the printing task and the result. If yes, the procedure goes to step S34, if no, the procedure goes to step S35.

The method of determining whether the paper is available for printing is: when the printing task is one-sided printing and the result is that the surface of the paper to be printed has not already been printed, determining that the paper is available for printing; when the printing task is one-sided printing and the result is that the surface of the paper to be printed has already been printed, determining that the paper is unavailable for printing; when the printing task is duplex or double-sided printing and the result is that both surfaces of the paper being printed are blank, determining that the paper is available for printing; when the printing task is duplex or double-sided printing and the result is that one surface or both surfaces of the paper have already been printed, then determining the paper is unavailable for printing.

In step S34, the control module 1075 controls the paper 103 to perform the printing task, and the procedure goes to S36.

In step S35, the control module 1075 controls the paper 103 not to perform the printing task, and the procedure goes to S36.

In step S36, the control module 1075 controls the feed roller assembly 101 to take the paper out of the print device 10.

The present disclosure identifies if the paper is available for printing via the printed surface identifying assembly 105, and performs the printing task only after identifying that the paper is available for printing, which saves resources and time.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A print device with printed surface identifying function, comprising:

a feed roller assembly;

a print assembly; and a printed surface identifying assembly, configured to identify whether a surface of a paper to be printed has already been printed when the printing task is one-sided printing, and identify whether both surfaces of the paper have already been printed when the printing task is duplex or double-sided printing, generate and send a result to a processing unit;

wherein the processing unit controls the printed surface identifying assembly to identify if one or both surfaces of the sheet of paper have already been printed and generates the result, determines whether the paper is available for printing according to the result, and control the print assembly not to perform the printing task and the feed roller assembly to take the paper out of the print device when the paper is unavailable for printing.

2. The print device of claim 1, wherein the processing unit determines whether the paper is available for printing according to: when the printing task is one-sided printing and the result is that the surface of the paper to be printed has not already been printed, determining that the paper is available for printing; when the printing task is one-sided printing and the result is that the surface of the paper to be printed has already been printed, determining that the paper is unavailable for printing; when the printing task is duplex or double-sided printing and the result is that both surfaces of the paper being printed are blank, determining that the paper is available for printing; when the printing task is duplex or double-sided printing and the result is that one surface or both surfaces of the paper have already been printed, then determining the paper is unavailable for printing.

3. The print device of claim 2, wherein the printed surface identifying assembly further comprises a light emitting module configured to emit uniform light onto one surface of the paper to be printed, a light receiving module configured to receive reflected light from the surface of the paper, and an identifying module configured to determine whether the reflected light is uniform thereby determining the surface of the paper to be printed has not been printed when the reflected light is uniform and the surface of the paper to be printed has already been printed when the reflected light is not uniform.

4. The print device of claim 3, wherein the light receiving module and the light emitting module are installed over or under the same surface of the paper being printed.

5. The printing method of claim 1, wherein the step of determining whether the paper is available for printing according to the printing task and the result further comprises: when the printing task is one-sided printing and the result is that the surface of the paper to be printed has not already been printed, determining that the paper is available for printing; when the printing task is one-sided printing and the result is that the surface of the paper to be printed has already been printed, determining that the paper is unavailable for printing; when the printing task is duplex or double-sided printing and the result is that both surfaces of the paper being printed are blank, determining that the paper is available for printing; when the printing task is duplex or double-sided printing and the result is that one surface or both surfaces of the paper have already been printed, then determining the paper is unavailable for printing.

6. The printing method of claim 5, wherein the printed surface identifying assembly further comprises a light emitting module, a light receiving module and an identifying module, and the method further comprising:

controlling the light emitting module to emit uniform light onto one surface of the paper to be printed;

controlling the light receiving module to receive reflected light from the surface of the paper, and controlling the identifying module to determine whether the reflected light is uniform thereby determining the surface of the paper to be printed has already been printed when the reflected light is not uniform and the surface of the paper to be printed has not already been printed when the reflected light is uniform.

7. The printing method of claim 6, wherein the light receiving module and the light emitting module are installed over or under the same surface of the paper to be printed.

8. A printing method comprising:

supplying a print device comprising a feed roller assembly, a print assembly, and a printed surface identifying assembly;

controlling the feed roller assembly to feed the paper into the print device when receiving a printing task;

controlling the printed surface identifying assembly to identify whether one or both surfaces of a sheet of paper have already been printed and generates the result, wherein when the printing task is one-sided printing, the printed surface identifying assembly only needs to identify whether the surface of the paper to be printed has already been printed, and when the printing task is duplex or double-sided printing, the printed surface identifying assembly needs to identify whether both surfaces of the paper have already been printed;

determining whether the paper is available for printing according to the result; and controlling the print assembly not to perform the printing task and the feed roller assembly to take the paper out of the print device when the paper is unavailable for printing.

* * * * *